United States Patent [19]

Östberg

[11] 4,440,203

[45] Apr. 3, 1984

[54] ARRANGEMENT FOR INSERTING BLOCKS OF TIMBER IN A TIMBER PROCESSING MACHINE

[75] Inventor: Sven E. Östberg, Söderhamn, Sweden

[73] Assignee: Kockums Industri AB, Soderhamn, Sweden

[21] Appl. No.: 275,904

[22] Filed: Jun. 22, 1981

[30] Foreign Application Priority Data

Jul. 3, 1980 [SE] Sweden ..... 8004918

[51] Int. Cl.[3] ..... B27C 9/00

[52] U.S. Cl. ..... 144/39; 83/360; 83/367; 144/176; 144/246 F; 144/369

[58] Field of Search ..... 144/3 R, 39, 162 R, 144/246 R, 246 F, 356, 357, 176, 373, 369; 83/360, 368, 371, 367

[56] References Cited

U.S. PATENT DOCUMENTS 3,692,074 9/1972 Nilsson ..... 144/39

4,239,072 12/1980 Merilainen ..... 144/357

4,316,491 2/1982 Kearnes et al. ..... 144/357

4,373,563 2/1983 Kenyon ..... 144/246 F

*Primary Examiner*—W. D. Bray

*Attorney, Agent, or Firm*—Seed and Berry

[57] ABSTRACT

An arrangement for feeding blocks of timber into a cutting machine has a stationary rear pair of lateral guide rollers immediately in front of the saw blades, a laterally displaceable front pair of lateral guide rollers and a middle lateral guide device, which may be a pair of lateral guide rollers. The middle lateral guide device is at half the distance between the front and the rear pair of lateral guide rollers. The front pair of lateral guide rollers is arranged on a support arm which can swing on a swivel point which is in front of the rear pair of lateral guide rollers at a distance of six tenths of a distance between the front and rear pair of lateral guide rollers. The arrangement is suitable for curved sawing both in sawing machines and in reducing and reducing sawing machines.

12 Claims, 14 Drawing Figures

CLS
100
1
1a
2
2a
P2
16
13
11
11a
P4
10a
10b
6
3
E
G
F
H
8
9
9'
7
5
P3
12a
12
E'
4
CLS
P1
5F = E'

CLS
1
1
100
14a'
2
2
2a
2a
P2
P2
16
11
P4
P4
11
13
11a
11a
10a
10b
6
3
3
9'
8
7
5
9
6
14a'
8
P3
12a
12a
12
12
7
CLB
4
4
14a'
L
CLS
P1

CLS
1
1
200
2
2
2a
2a
22
22
20
20
35
35
35
23a
23b
21
21
21'
21'
20a
20a
35
-25-
34
34
5
17a
24a
24b
7
4
4
4'
4'
40
40
E
G
F
E'
I
CLS
17b
113
113
113a
113a
P1

CLS
200
1
2
2a
20
22
35
23a
23b
21
21'
20a
5
14b'
14b''
-25-
34
24a
24b
7
4
4'
40
14b
113
113a
P1

Fig. 7
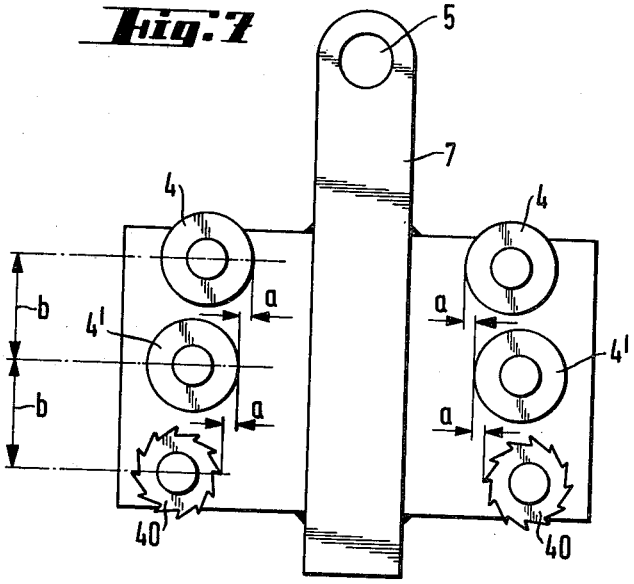
Fig. 8a
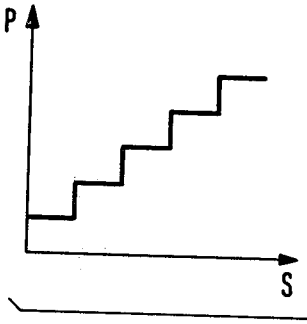
Fig. 8b
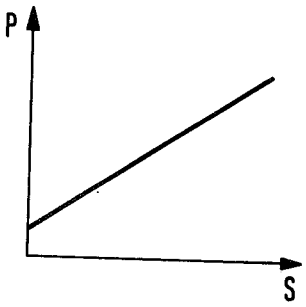
Fig. 8

-142b-
-141b-
-140b-
140b
40
4
4'
5
7
a
b
IX d

ARRANGEMENT FOR INSERTING BLOCKS OF TIMBER IN A TIMBER PROCESSING MACHINE

TECHNICAL FIELD

The invention relates to an arrangement for inserting blocks of timber in a timber processing machine such as a reducing machine, a sawing machine or a reducing sawing machine, for example of the type described in detail in U.S. Pat. No. 3,692,074.

BACKGROUND ART

The raw materials situation no longer permits the rejection of curved sawing timber, which accounts for approximately 33% of the timber available for sawing. The technique of "curve sawing" in which the saw cut or cuts are essentially similarly curved as the centre line of the piece of timber, produces boards and planks which are broadly equivalent to boards and planks obtained from completely straight pieces of timber. However, existing sawing equipment is largely designed to saw straight pieces of timber. The purpose of the invention is to achieve a simple and effective arrangement for inserting straight or curved blocks which are machined or are to be machined on at least two opposite sides.

DISCLOSURE OF THE INVENTION

The principal object of the invention is to automatically position a length of timber (which may be curved) so that its center line at the teeth of a saw blade is tangent to the cutting axis of the saw blade.

This and other objects of the invention are accomplished by positioning two spaced-apart points on the center line of the timber respective distances from the cutting axis of the saw blade which are a fixed ratio depending upon the spacing of the points from the saw blade. The ratio is selected so that the points on the center line of the timber coincide with an arcuate line that is tangent to the cutting axis of the saw blade at the teeth of the blade.

BRIEF DESCRIPTION OF THE DRAWINGS

FIG. 7 is a top plan view of an alternative feed roller guide mechanism adapted for use with tapered timber.

FIGS. 8*a* and 8*b* are schematics showing alternative techniques for transversely displacing the timber.

BEST MODE FOR CARRYING OUT THE INVENTION

Figures 1, 2A, 2B:
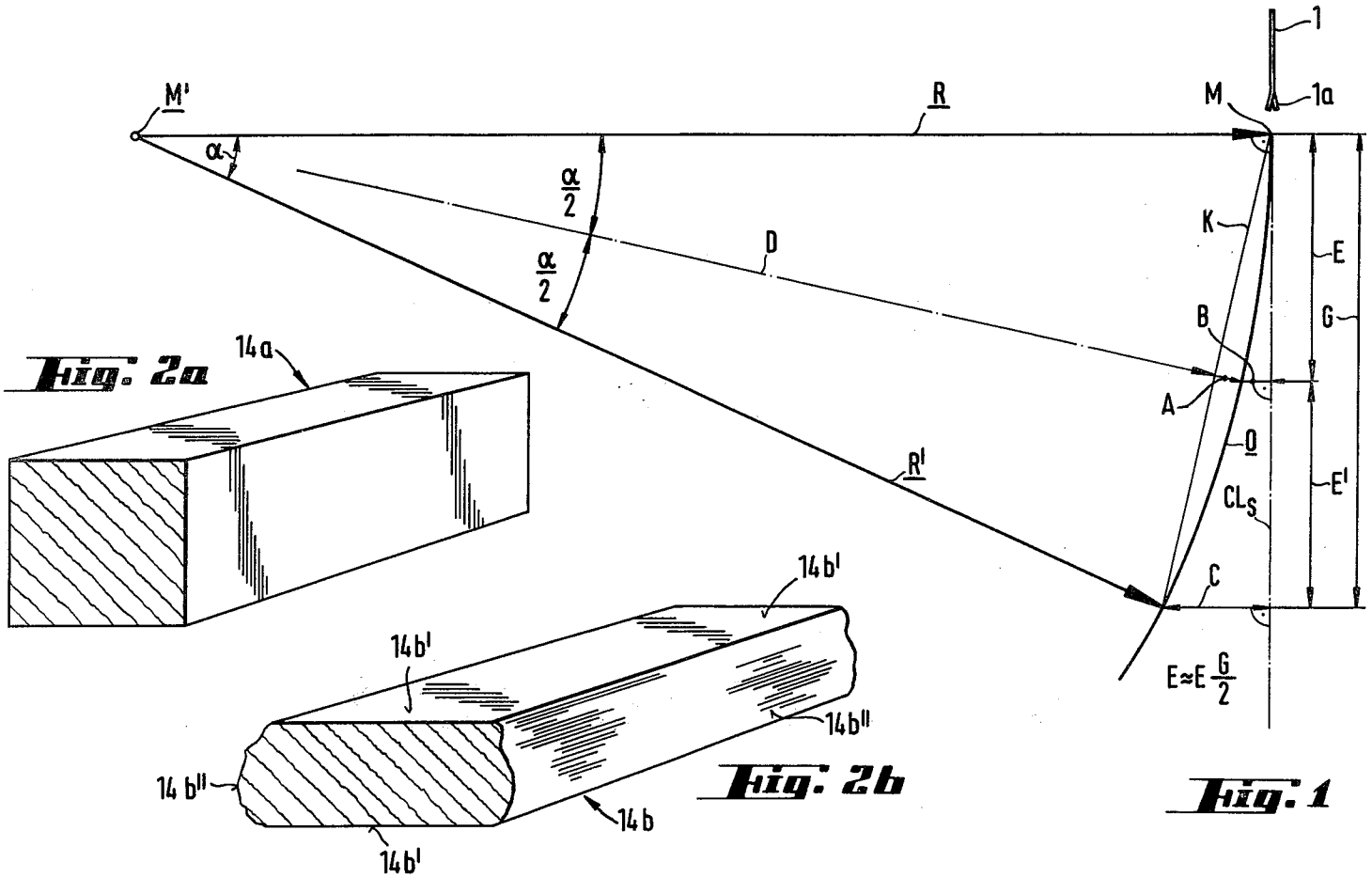
FIG. 1 is a schematic illustrating the geometric principles applicable to the invention.
FIGS. 2*a* and 2*b* are isometric views of two types of timbers which may be fed into the timber processing machine.

The direction of sawing of the saw blades relative to the central line of a curved block must always be a tangent to the arc that the centre line may be assumed to form at the point in question. In other words the direction of sawing must be at right angles to the radius of the said arc. The centre line of a straight block forms an arc of infinite radius. FIG. 1 shows a saw blade 1 with a row of teeth 1*a*, the direction of sawing being represented by the centre line $CL_s$ of the sawing machine in question. At M' at the tip of the saw tooth a line of arbitrary length, known as the radius R, is drawn at right angles to the line $CL_s$. Starting from the other end M of this line, a segment of a circle with an arbitrary centre angle $\alpha$ is drawn with the aid of a second radius R' and an arc O. The segment is bisected by a line D into two equal sub-segments, and a chord K is drawn across the entire arc O. On the basis of known geometrical rules the distance A on the bisecting line D between the chord and the arc is substantially equal to the distance B on a line meeting the bisecting line and perpendicular to the centre line $CL_s$ between arc O and this centre line. Further more, the ratio of each of them to the distance C on a line joining radius R' and perpendicular to centre line $CL_s$ is 1:4 regardless of the magnitude of the radius R and/or the centre angle (as long as the centre angle $\alpha$ is relatively small) , i.e.

$$4A=4B=C \tag{1a}$$

In the more general case, according to known principles of geometry, the distance C with respect to the distance B for any portions of the centre angle $\alpha$ is given by the formula $$\frac{B}{C}=\frac{1-\cos\alpha'}{1-\cos\alpha'} \tag{1b}$$

where $\alpha'$ is the angle dividing the angle $\alpha$.

The present invention is based on these formulae (1*a* and 1*b*). since the piece of timber is positioned so that its centre line coincides with the arcuate line of FIG. 1. This positioning is accomplished by transversely positioning the centre line of the timber at point G a distance C from the centre line $CL_S$, which is larger than the distance B from the centre line $Cl_S$ at point E by a factor of $(1-\cos\alpha')\times(1-\cos\alpha)$. For $\alpha'=\alpha/2$, this factor is about 0.25. For $\alpha'=\alpha/3$, this factor is about 0.11.

Figure 3:
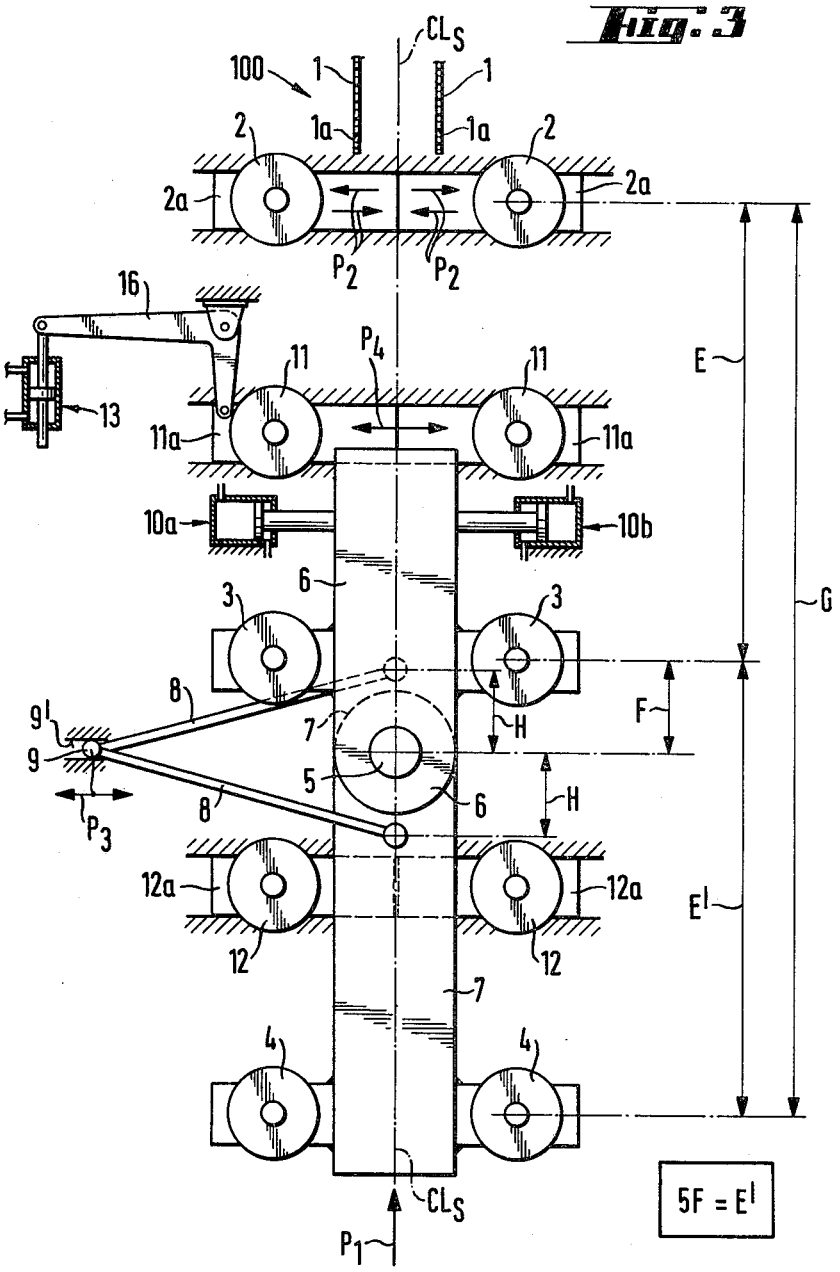
FIG. 3 is a top plan view of one embodiment of the invention.
Figure 5:
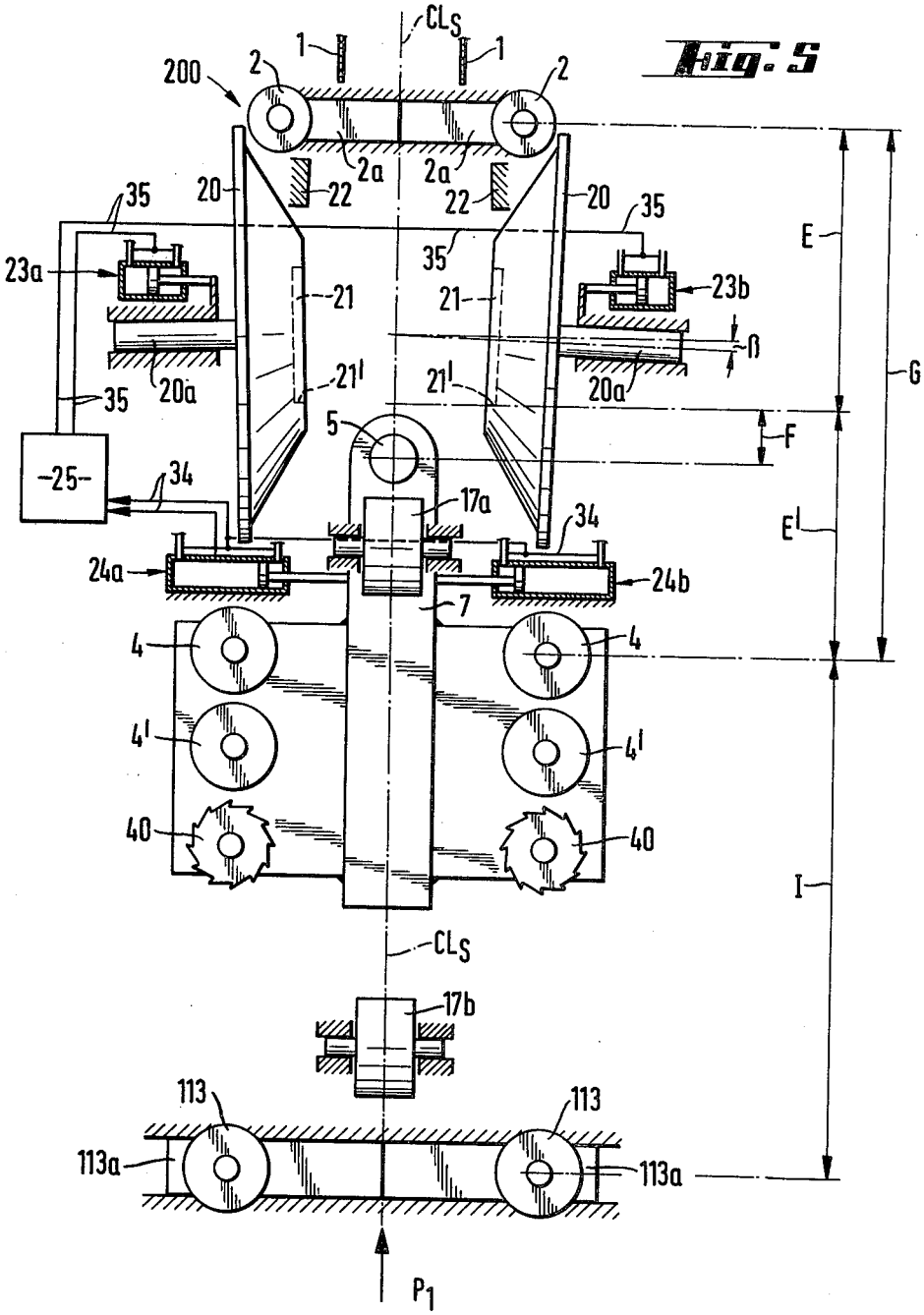
FIG. 5 is a top plan view of another embodiment of the invention.
Figure 6:
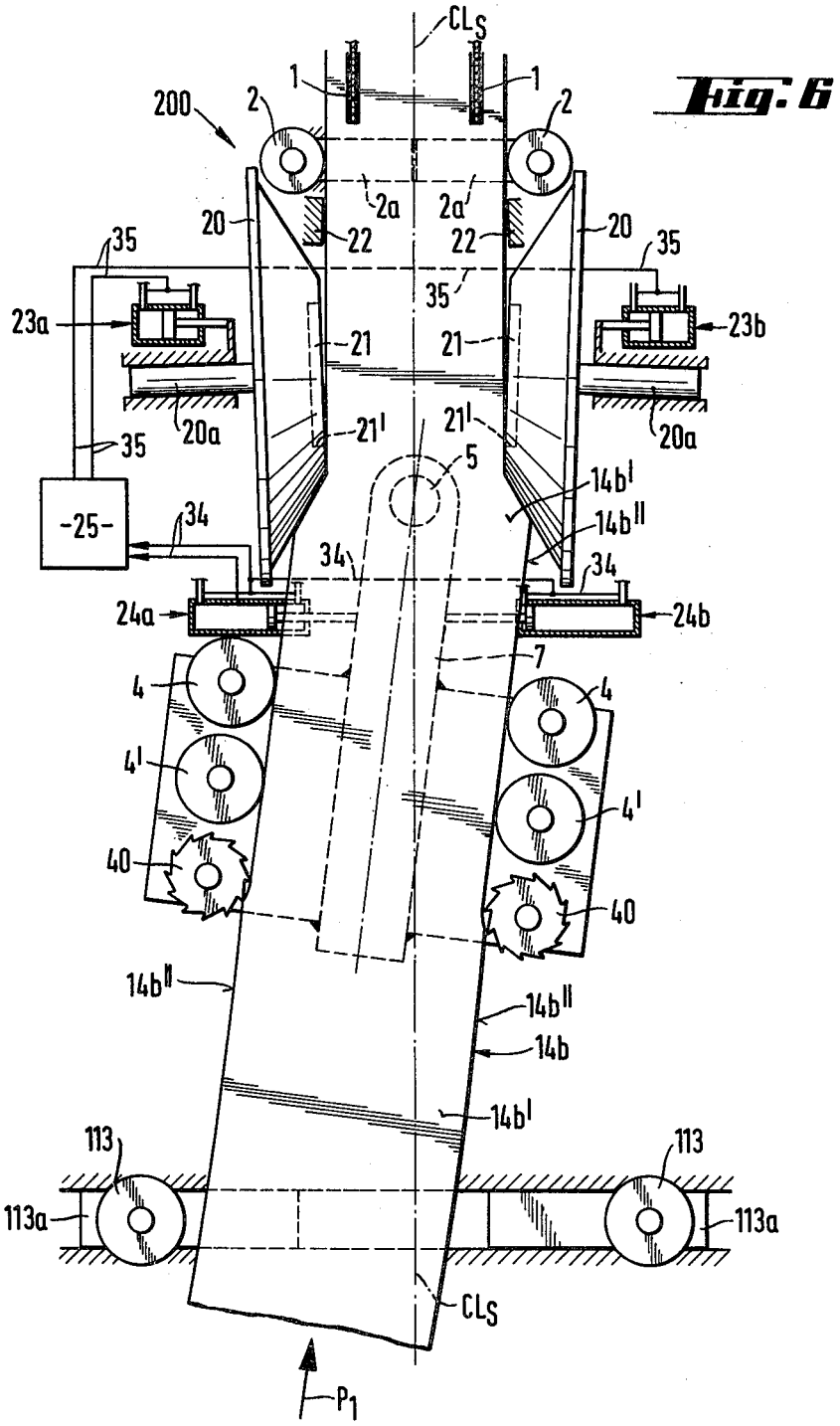
FIG. 6 is a top plan view of the embodiment of FIG. 5 shown feeding a curved block of timber into a saw blade.

Shown in FIG. 2*a* is an oblong block 14*a* which is already machined on all four sides and which is to be cut in an arrangement according to FIG. 3. FIG. 2*b* shows a "normal block" 14*b* which has been worked on only two opposite sides 14*b*, and which is to be further processed on the remaining side faces 14*b*'' and cut in a reducing saw 200 such as shown in FIGS. 5 and 6.

According to FIG. 3, a sawing installation 100, which, for example, may comprise in a known manner two band saws set up alongside each other, has two saw blades 1 with saw teeth 1*a*. The sawing installation has a centre line $CL_S$ corresponding to line $CL_S$ in FIG. 1. Along this centre line, on the feed side of the installation, a number of pairs of guide rollers are arranged. The expression "guide rollers" in this description and in the attached claims means two guide rollers which have vertical spindles and which are arranged in a known manner to be able to move towards and away from each other on their carriers, depending on the width of the guided piece of timber. This conventional width adjustment function is present on all the pairs of guide rollers shown, but is not set out in detail in the drawings.

Immediately before saw blades 1 a rear pair of lateral guide rollers 2, 2 is arranged on a stationary carrier 2*a*, i.e. roller pair 2, 2 is mounted so that their rotational axes cannot move relative to centre line $CL_S$, but the rollers 2 may rotate about such axes. However, rollers 2 can, depending on the width of a passing block of timber, move jointly towards or away from each other in the manner mentioned above, which is indicated symbolically—and this applies to all the pairs of lateral guide rollers shown on the drawings—by two arrows $P_2$ for each roller 2. The position of this lateral guide roller pair 2, 2 corresponds to the point M in the geometrical diagram in FIG. 1. A rear (viewed in the direction of feed $P_1$) support arm 6 and a separate front support arm 7 independently pivot on a, swivel point 5 on centre line $CL_S$. In their neutral position, the centre lines of support arms 6 and 7 run coaxially with centre lines $CL_S$. Swivel point 5 is stationary and is situated at a distance E+F in front of the rear pair of lateral guide rollers 2, 2,. In order to establish the geometrical relationships shown in FIG. 1, the distance F is selected so that:

$$F = \frac{E'}{5} \tag{2}$$

as a result:

$$E + F = \frac{6}{10} G, \tag{3}$$

since G=2 E as FIG. 1 shows.

Mounted on the front support arm 6 at a distance G in front of the rear pair of lateral guide rollers 2, 2 is mounted a front pair of lateral guide rollers, 4, 4 which position the centre line of the timber a distance C (as in FIG. 1) from the centre line $CL_S$. On the rear support arm 6 at a distance E in front of the rear pair of lateral guide rollers 2, 2 a middle pair of lateral guide rollers 3, 3 is arranged which position the centre line of the timber a distance B (as in FIG. 1) from the centre line $CL_S$. At equal distances H from swivel point 5 there is a rigid strut 8 connected at one end in a pivoting manner to each support arm 6, 7. The other ends of the two struts 8 are connected together in a pivoting manner at a hinge 9 which can slide at right angles to the centre line $CL_S$ in the direction of the double arrow $P_3$. It is important to note that hinge 9 cannot slide in the direction of this centre line. Because of the arrangement of struts 8, the rotation of support arm 6 about point 5 is equal and opposite to the rotation of support arm 7 about point 5. Because swivel point 5 divides the distance E' between the middle pair 3, 3 and the front pair 4, 4 of lateral guide rollers in the ratio of 1:4, the geometrical conditions set out in FIG. 1 are achieved. In other words, since the rollers 4, 4 are spaced from the swivel point 5 a distance of four times greater than the spacing between the rollers 3, 3 and the swivel point 5, equal and opposite rotations of the support arms 6, 7 move the rollers 4, 4 transversely a distance of four times the transverse movement of rollers 3, 3. If the rear pair of lateral guide rollers 4, 4 is moved sideways by a curved block of timber (corresponding to the distance C in FIG. 1). struts 8 also move the middle pair of lateral guide rollers 3, 3 laterally (corresponding to the distance B in FIG. 1), but only by one quarter of the distance covered by the rear pair. For other ratios of E:G, the spacings of the rollers 3, 3 and 4, 4 from the swivel 5 can be adjusted so that the centre line of the timber follows the arcuate curve of FIG. 1. Alternatively, the degree of rotation of support arm 6 with respect to that of support arm 7 may be adjusted such as by repositioning the point of attachment between one strut 8 and one support arm 6 or 7. In any case, in the rear pair of lateral guide rollers 2, 2, the centre line $CL_B$ of a curved block 14*a*' (FIG. 4) forms a tangent to the centre line $CL_S$ of the sawing installation, and this situation is maintained during the entire feeding operation. Struts 8 act here either as pull-rods or as push-rods, depending on whether the curvature of the block of timber is in one or the other direction relative to the hinge 9.

Other interconnecting mechanisms causing equal and opposite rotation of the support arms 6, 7 may alternatively be used.

Figure 4:
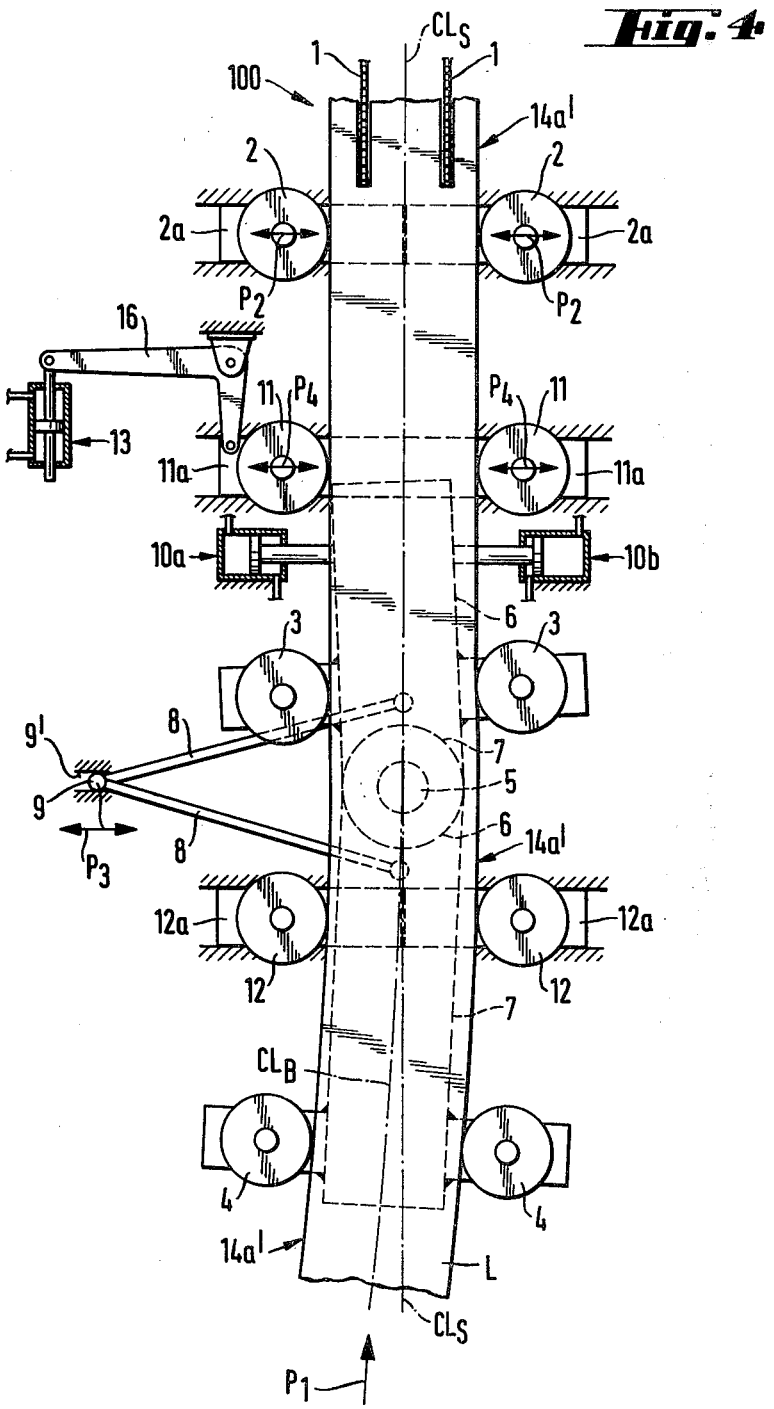
FIG. 4 is a top plan view of the embodiment of FIG. 3 shown feeding a curved block of timber into a saw blade.

FIG. 4 shows the situation on feeding in a block of timber 14*a*' curved to the left. In the case of a straight block, support arms 6, 7 are in line with each other.

On either side of the rear support arm 6 is mounted a stabilising drive unit in the form of a stationary single-acting cylinder-piston assembly, 10*a* 10*b* powered by a medium under pressure. The assemblies are arranged to hold support arm 6 in the neutral position coaxial with the centre line $CL_S$ as shown in FIG. 3, and so that, when support arm 6 swings out laterally, as shown in FIG. 4, the cylinder-piston assembly actuated by the swinging support arm will force support arm 6 back to the neutral position, whilst the other cylinder-piston assembly remains passive and only "resists" the support arm when it has again reached the neutral position. Further pairs of lateral guide rollers such as 11, 11 and 12, 12 can be arranged between the front and rear pairs of lateral guide rollers 2, 2 and 4, 4. Whilst lateral guide roller pairs 2, 2, 3, 3 and 4, 4 may be referred to as "primary", since they position the centre line of a timber along the arcuate line of FIG. 1 these additional pairs of lateral guide rollers such as 11, 11 and 12, 12 can be reffered to as "secondary". The carriers, 11*a*, 12*a* of the secondary pairs of lateral guide rollers are not supported by either of support arms 6, 6, but are mounted so that they cannot turn relative to centre line $CL_S$, although they can be displaced laterally to be able to follow the contours of a passing block of timber 14*a*'. Here the secondary pair of lateral guide rollers 11, 11 between the rear and middle primary lateral guide rollers 2, 2 and 3, 3 is connected via a bell-crank lever 16 to a double-acting cylinder-piston assembly powered by a medium under pressure, which is arranged to lock the lateral displacement motion of roller pair 11, 11 in the direction of double arrow $P_4$ when the end section L (FIG. 4) of a passing block of timber has reached a selected position beyond the middle primary lateral guide roller pair 3, 3, so that this end section cannot freely swing laterally. For a straight block of timber, roller pair 11, 11 is locked in the centred position relative to the centre line $CL_S$ by cylinder-piston assembly 13.

All the pairs of lateral guide rollers are volume-centred and powered in a conventional manner, and for the sake of clarity this is not shown in the drawings. The block of timber is transported on a conventional chain, a roller table or similar, which is arranged above support arms 6, 7 and is also not shown in the drawings.

In the case of straight blocks the arrangement described acts as an ordinary guide mechanism for straight sawing, regardless of the dimension of the block. Pliable curves blocks are forced by the force from cylinder-piston assembly 10*a*, 10*b* to take on a straight shape when they pass through the arrangement. Thicker curved blocks which assemblies 10*a*, 10*b* are not strong enough to straighten out, automatically deflect front arm 7 with its torque point at the rear pair of rollers 2, 2 in the geometrical manner described above. The effect achieved in this way is that the block itself, regardless of its form (straight, curved right, curved left) is the information-carrier for the setting of the feed-in arrangement relative to the sawing installation.

FIGS. 5 and 6 show an arrangement according to the invention for use in conjunction with a reducing saw to process normal blocks as shown in FIG. 2*b*. A reducing saw of this type is described in the above-mentioned U.S. Pat. No. 3,692,074. For identical quantities and parts the identical reference numbers are used as in FIG. 3.

Reducing saw 200 has two saw blades 1 and two reducing discs 20, for example of the type described in U.S. Pat. No. 3,645,308, and which each have a central disc 21 to guide the justmachined flat surface of the block. The shafts 20*a* of reducing discs 20 are at a slight angle ($\beta$) to their straight interconnecting line, so that the reducing discs have a slightly "toedin" setting relative to the feed of direction $P_1$. Reducing discs 20 are each adjustable by means of hydraulic-position servo 23*a*, 23*b*. Arranged between reducing discs 20 and saw blades 1 there are flat guiding surfaces 22 which are angled in the opposite direction to the reducing discs, i.e. "toed-out" relative to the feed direction and line $CL_S$. The rear pair of guide rollers, 2, 2 is arranged between reducing discs 20 and saw blades 1. In this embodiment the front peripheral part 21' in the feed direction of central discs 21 corresponds to the middle guide roller pair 3, 3 since it positions the centre line of a timber a distance B from the centre line $CL_S$, as illustrated in FIG. 1. The peripheral part 21' is at a distance E in front of the rear guide roller pair 2, 2, which in this case is arranged between reducing discs 20 and saw blades 1.

In front support arm 7 carries the front lateral guide roller pair 4, 4, in front of this a similar lateral guide roller pair 4', 4', and in front of this a pair of cutters 40, 40, whilst the rear support support arm 6 (and the middle lateral guide roller pair 3, 3) are completely omitted. The purpose of the pair of cutters 40, 40 is to remove any branches and projections that spoil the form of the as yet unworked side faces 14*b*''of a normal block 14*b* (FIG.1). Machining by the cutters also enables the lateral guide rollers to make contact with the block of timber even when its root end is in the process of passing. Two double-acting cylinder-piston assemblies 24*a*, 24*b* powered by a medium under pressure interact with support arm 7 in exactly the same way as assemblies 10*a*, 10*b* do with support arm 6. However, assemblies 24*a*, 24*b* are arranged to act as position transmitters at the same time. When one of these assemblies is activated, for example assembly 24*a* when support arm 7 is swung to the left by a curved block of timber, signals are carried via one of conductors 34 to an evaluation unit (computer) 25 in which these signals are converted into control signals for the two reducing discs 20, the said control signals being carried via conductors 35 to the two position servo devices 23*a*, 23*b* or alternatively to a distributor (not shown for clarity) which controls the supply of pressurised fluid from a source (not shown) to these devices. The two reducing discs 20 are then moved jointly the same distance in the same direction—to the left in the present example—in an analogous manner as the middle lateral guide roller pair 3, 3 in FIG. 3, 4 would be displaced in such a case, i.e. in the same direction from the centre line $CL_S$ as the front pair of lateral guide rollers 4, 4, but only through one-quarter of the distance of this pair. Depending on the mode of action of the devices, this displacement can be achieved step-by-step or continuously, as shown schematically in FIGS. 8*a* and 8*b*, where the ordinate axis represents the pressure P acting on assembly 24*b* when support arm 7 swings out to the right, and the abscissa shows the axial distance S through which the two reducing discs 20 are displaced. The embodiment of FIG. 5 illustrates that a variety of positioning devices may be employed to position the two spaced-apart points on the centre line of a piece of timber respective distances from the centre line $CL_S$ which are a fixed ratio to each other, depending upon the location of such points.

Forward feeding of the block of timber is achieved by two retaining rollers 17*a*, 17*b*, which can be lowered from above, and both of which are powered.

At a distance I (corresponding to about a third of the average block length) in front of the front lateral guide roller pair 4, 4, a pair of receiving lateral guide rollers 113, 113 is arranged on a carrier 113*a* which, like carrier 2*a* is fixed relative to centre line $CL_S$. Together with roller pair 4, 4, roller pair 113, 113 is intended to centre the top of an entering block of timber, and after this centering it must open fully (i.e. rollers 113 must be set to the greatest possible distance apart) in order not to interfere with the block when it is gripped by the other lateral guide rollers. Since dimension adjustment can be done by steps, it can also be made possible to limit the swing of support arm 7, which means that the servo system is locked for such great arch heights of the block curvature which might otherwise cause excessive "stress" on the side boards after saw blades 1, as will be explained in more detail with reference to FIG. 9.

As is known, blocks of timber and logs have a different taper (conicity) depending among other things on which part of the tree (root part, middle part, top part) they come. According to FIG. 7, lateral guide roller pairs 4, 4, 4', 4' and cutter pair 40, 40 may with advantage have a convergent arrangement, in which case the dimension a (shown exaggerated in FIG. 7) is chosen to correspond to the normal taper of the pieces of timber, and for normal diameters for lateral guide roller and cutter is of the order of 1 mm when the distances b between lateral guide rollers 4, 4' and between the lateral guide rollers 4' and cutters 40, is 250 mm in the feed direction.

However, the "normal taper" of a tree trunk depends on the geographical origin of the trunk, and dimension a may therefore vary. Briefly summarised, the operation of the arrangement is as follows:

Saw blades 1 and reducing discs 20 are set to a preselected setting-up position. Roller pairs 4, 4 and 13, 13 centre the top end of a block of timber as it is fed in, and then open fully.

Retaining rollers 17*a*, 17*b* go down and advance the block as far as the rear pair of guide rollers 2, 2. Retaining rollers 17*a*, 17*b* are then raised and the front of the lateral guide rollers 4, 4 together with rollers 4', 4' and cutters 40, 40 move in towards the sides 14'' of block 14*b* and then sense the shape of the passing block. Cylinder-piston assembly 24*a*, 24*b* feed corresponding signals via wires 34 to evaluation unit 25.

Lateral guide rollers 2, 2 and 4, 4 are driven and volume-centred in known manner. Lateral guide roller pair 13, 13 are also volume-centred. The block is transported on a chain, roller table or similar (not shown) arranged above support arm 7. Obviously separate position transmitters may be arranged to detect the position of support arm 7 instead of assemblies 24*a* 24*b*.

Figures 9, 9A, 9B, 9C, 9D:
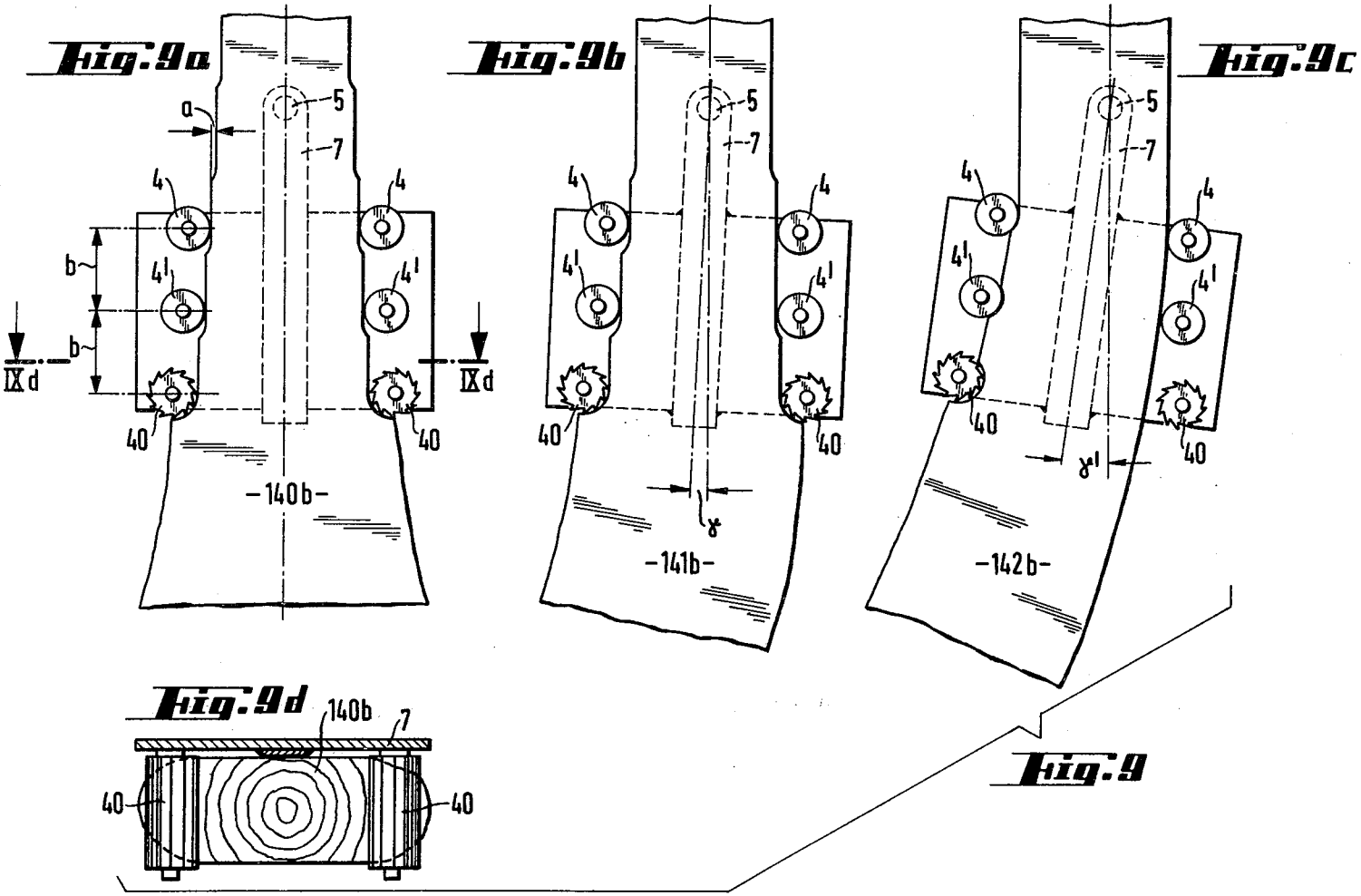
FIGS. 9*a* to 9*d* show the operation of the invention with three block of timber having varying curvatures.

With the aid of three normal blocks 140*b*, 141*b*, 142*b*, with different curvature, FIG. 9 shows three different methods of dimension adjustments. Straight block 140*b* represents the "normal case" (zero curvature) without any swing of arm 7. Block 141*b* is curved within normal limits, and arm 7 swings out to the angle $\gamma$. Block 142*b* is sharply curved, the swing of arm 7 is limited to a pre-set maximum angle $\gamma'$, and the block is prereduced (milled by one of cutters 40) only on the side to which it is curved. The taper of all three blocks 140*b*, 141*b*, 142*b* is broadly the same.

It is clear that the invention may also be used to advantage for inserting block into a reducing machine. A reducing machine differs from a reducing saw according to FIGS. 5 and 6 in that there are no saw blades after the reducing discs. As can be seen from the description for FIGS. 5 and 6, these saw blades do not take part in any way in the insertion process according to the present invention.

Unlike other methods for "sawing on a curve" in which the form of the piece of timber is detected by separate sensing devices such as cameras, stops etc., in the arrangement according to the present invention the block of timber is itself the information-carrier as regards its form (straight, curved right, curved left) for correct setting relative to the saw. On use in a reducing saw it is possible, thanks to the geometrical theory behind it and the "pre-reducing" function of cutters 40, 40, to carry out "curve sawing" of a normal block on a reducing saw as well, something which has hitherto not been possible.

I claim:

1. An apparatus for feeding a block of timber along a feed path into a timber processing machine having at least one processing tool operating along a fixed centre axis, said apparatus comprising:

first guide means for said block positioned directly in front of said processing machine, said guide means positioning the centre of said block substantially on said centre axis;

second guide means for said block positioned a first distance from said first guide means, said guide means being movable perpendicularly to said centre axis to position the centre of said block a second distance from said centre axis;

third guide means for said block positioned a third distance from said first guide means, with said second guide means positioned therebetween, said third guide means being movable perpendicularly to said centre axis to position the centre of said block a fourth distance from said centre axis; and control means for simultaneously moving said second and third guide means perendicularly to said centre axis in fixed relation to each other so that said second and fourth distances lie on an arcuate line which is tangent to said centre axis at said processing tool.

2. The apparatus of claim 1 wherein said second guide means is positioned midway between said first and third guide means and wherein said control means moves said third guide means a distance which is four times greater than the movement of said second guide means so that said fourth distance if four times larger than said second distance.

3. The apparatus of claim 1 wherein said first, second and third guide means include a pair of rollers rotatably mounted on a base plate, said rollers being resiliently biased toward each other to accommodate a variety of block sizes.

4. The apparatus of claim 3 wherein the base plates for said second and third guide means are moved by said control means perpendicular to said centre axis to position the centre of said block at the point midway between said rollers on said arcuate line.

5. The apparatus of claim 1 wherein said control means is a mechanical linkage interconnecting said second and third guide means to cause said third guide means to move a distance which is a fixed multiple of the movement of said second guide means, said second and third guide means being displaceable in a direction perpendicular to said centre axis by the curvature of said timber.

6. The apparatus of claim 5 wherein said mechanical linkage includes a first support frame on which said second guide means are mounted, a second support frame on which said third guide means are mounted, swivel means for pivotally mounting said first and second support frame about a common rotational axis on said centre axis, said centre axis being spaced a fifth distance from said second guide means and a sixth distance from said third guide means, and interconnecting means for causing said first and second support frames to rotate at said swivel means in opposite direction at a fixed rate with respect to each other so that movement of said second guide means perpendicular to said second axis with respect to movement of said first guide means perpendicular to said second axis is proportional to the ratio of said fifth distance to said sixth distance and to the fixed rotational relationship between said first and second support frames.

7. The apparatus of claim 6 wherein said interconnecting means includes a pair of rigid struts having one of their ends pivotally connected to a respective support frame at predetermined distances from the rotational axis of said swivel means, with the other ends of said strust pivotally secured to a slide which is constrained to move in a straight line perpendicular to said centre axis.

8. The apparatus of claim 1, further including a pair of infeed guide rollers positioned between said first and second guide means and infeed guide roller actuating means for selectively moving said infeed guide rollers toward each other to guide the end of said block of timber into said first guide means and then retracting to allow said timber to move perpendicularly to said central axis responsive to movement of said second and third guide means.

9. The apparatus of claim 1 wherein said second guide means comprise a pair of reducing discs spaced apart from each other on opposite sides of said centre axis, actuating means for displacing said reducing discs perpendicularly to said centre axis responsive to a control signal, transducer means for measuring the displacement of said third guide means perpendicularly to said centre axis and for generating said control signal in response thereto, the edges of said reducing discs facing away from said processing means being spaced said first distance from said first guide means so that the position of the leading edges of said reducing discs position the center of said block along said arcuate line.

10. The apparatus of claim 9 wherein said third guide means includes a support frame pivotally mounted about an axis of rotation intersecting said centre axis and extending generally away from said processing tool, a pair of spaced-apart guide rollers mounted on said support frame, and wherein said transducer means includes means for measuring the rotational position of said support frame to provide an indication of the position of the midpoint between said guide rollers in a direction perpendicular to said centre axis.

11. The apparatus of claim 10, further including a pair of cutters mounted on said support frame on opposite sides of said centre axis, said cutters being positioned away from said processing tool with respect to said third guide means for preliminarily reducing the width of said timber before entering said third guide means.

12. The apparatus of claim 11 wherein the spacing between said cutters is larger than the spacing between said guide rollers to form a convergent arrangement approximately corresponding to the taper of said block of timber.

* * * * *